United States Patent [19]

Laninga et al.

[11] Patent Number: 4,830,609

[45] Date of Patent: May 16, 1989

[54] CURING OVEN SYSTEM FOR SEMICONDUCTOR DEVICES

[75] Inventors: Albert J. Laninga, Tempe; Marjorie S. Baxter, Mesa, both of Ariz.

[73] Assignee: Motorola, Inc., Schaumburg, Ill.

[21] Appl. No.: 205,887

[22] Filed: Jun. 13, 1988

[51] Int. Cl.[4] ..... F27D 15/02

[52] U.S. Cl. ..... 432/77; 432/78; 432/81; 432/83

[58] Field of Search ..... 432/77, 78, 81, 83, 432/121, 126, 130, 152, 189, 241

[56] References Cited

U.S. PATENT DOCUMENTS

| | | | |
|---|---|---|---|
| 1,658,333 | 2/1928 | Hanley, Jr. | 432/81 |
| 2,201,988 | 5/1940 | Cope | 432/83 |
| 2,205,182 | 6/1940 | Whitten | 432/83 |
| 3,470,624 | 10/1969 | Plotkowiak | 432/81 |
| 4,249,895 | 2/1981 | Mantegani | 432/78 |
| 4,560,348 | 12/1985 | Moller et al. | 432/77 |
| 4,773,851 | 9/1988 | Mueller | 432/77 |

*Primary Examiner*—Henry C. Yuen

*Attorney, Agent, or Firm*—Harry Wolin

[57] ABSTRACT

An automated curing oven system for use in the manufacturing of semiconductors. This system may easily be incorporated with other automated machinery used for various semiconductor processing steps because it employs the same device holding magazine used for many other steps. The device holding magazine serves as the oven chamber itself thereby eliminating many manual handling steps.

19 Claims, 4 Drawing Sheets

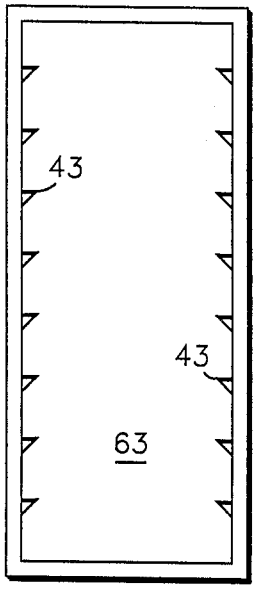
FIG. 4
FIG. 5
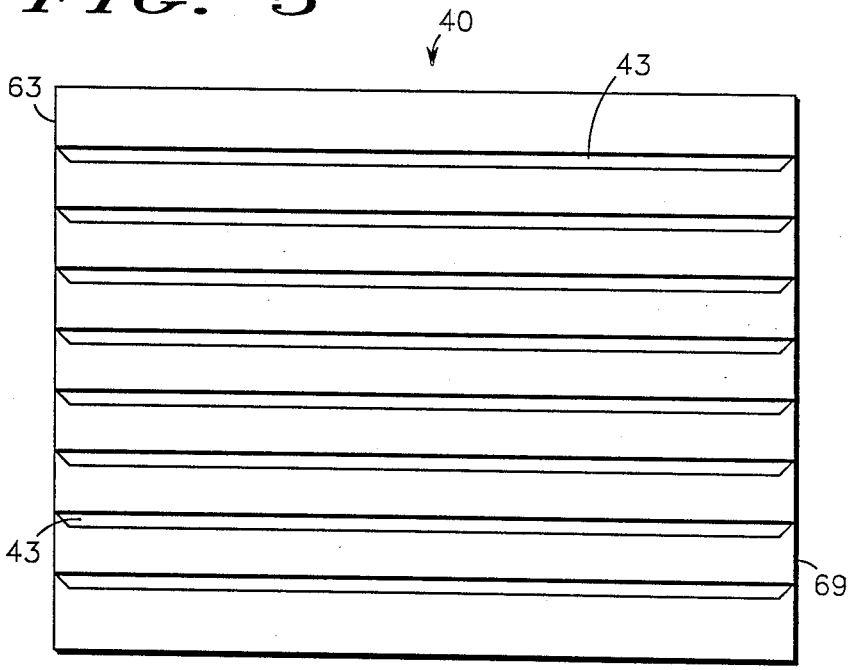

CURING OVEN SYSTEM FOR SEMICONDUCTOR DEVICES

BACKGROUND OF THE INVENTION

This invention relates, in general, to a curing oven system for semiconductor devices, and more particularly to an automated curing oven system for semiconductor devices wherein the magazine containing the semiconductor devices is itself used as an oven chamber.

In the processing of semiconductor devices, there are many steps in which organic adhesives such as epoxy and polyimide must be cured. At the present time, these curing steps are generally performed by manually unloading magazines containing semiconductor devices and placing the separate devices into free standing batch ovens. Because the batch ovens are separate from other processing equipment, a relatively large amount of floor space is used while the manual handling steps are extremely labor intensive. Therefore, an automated curing oven system for semiconductor devices which may be integrated with other processing machinery is highly desirable.

SUMMARY OF THE INVENTION

Accordingly, it is an object of the present invention to provide a curing oven system for semiconductor devices which eliminates the need for separate batch ovens thereby eliminating many manual handling steps.

It is an additional object of the present invention to provide a curing oven system for semiconductor devices which enables feedback to the operator of equipment status.

Yet a further object of the present invention is to provide a curing oven system for semiconductor devices which requires a reduced amount of floor space.

An even further object of the present invention is to provide a curing oven system for semiconductor devices which uses a magazine containing the semiconductor devices as an oven chamber.

The foregoing and other objects and advantages are achieved in the present invention by providing a curing oven system for semiconductor devices. A magazine containing semiconductor devices which is used in other processing steps is transported into the curing oven system so that it is coupled between a manifold and exhaust maniflow. Heated gas then flows through the magazine. The magazine is used as an actual oven chamber thereby curing the organic adhesives. An even cure is obtained by distributing the heated gas through a manifold and into the magazine rather than heating the outside of the magazine. Following the curing, a cool gas flow is directed through the magazine thereby cooling the semiconductor devices so that oxidation will not occur and subsequent processing steps may be performed.

A more complete understanding of the present invention can be attained by considering the following detailed description in conjunction with the accompanying drawings.

BRIEF DESCRIPTION OF THE DRAWINGS

FIG. 4 is an end view of a device holding magazine; and

FIG. 5 is a cross-sectional view of a device holding magazine.

DETAILED DESCRIPTION OF THE INVENTION

Figure 1:
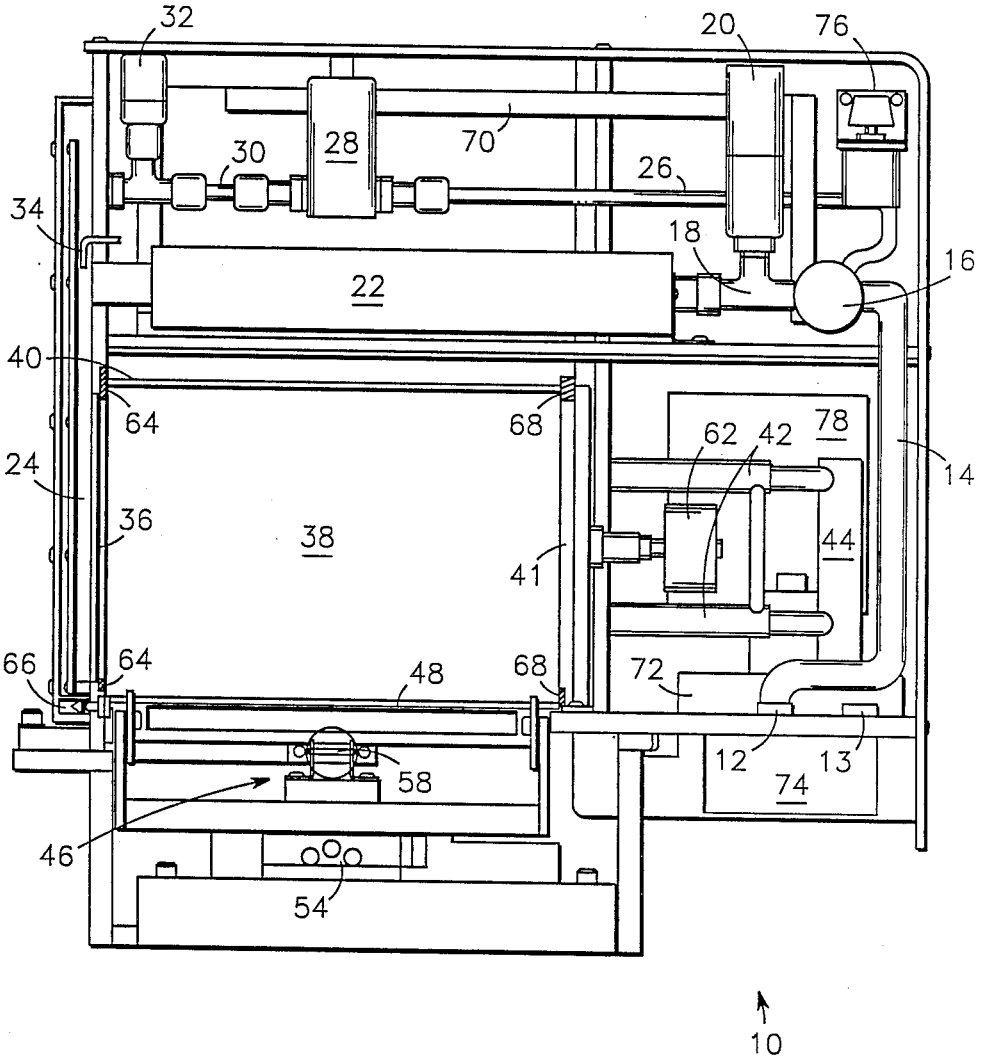
FIG. 1 is a schematic front view of an automated curing oven system for semiconductor devices in accordance with the present invention.
Figure 2:
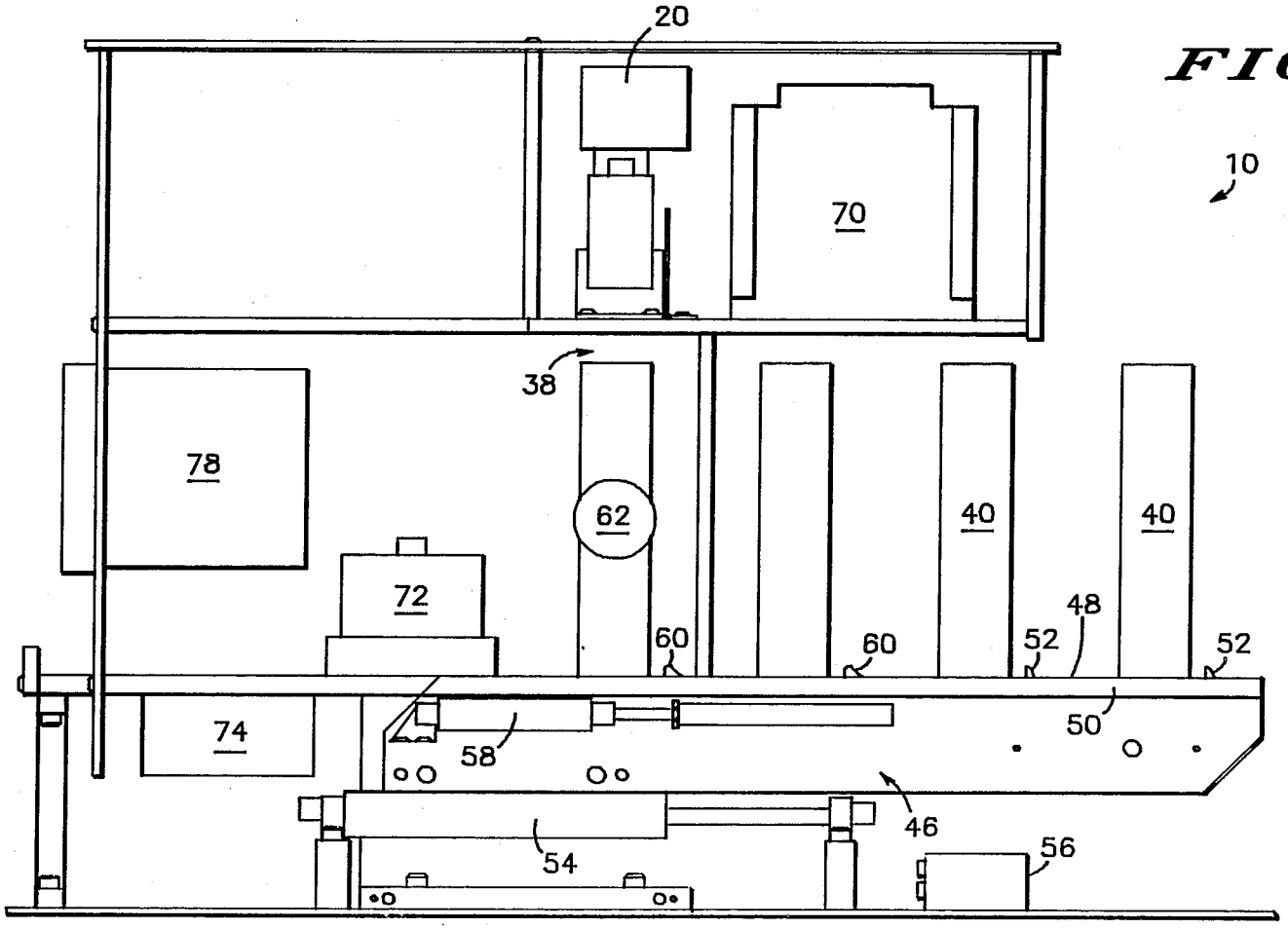
FIG. 2 is a schematic side view of the automated curing oven system for semiconductor devices.
Figure 3:
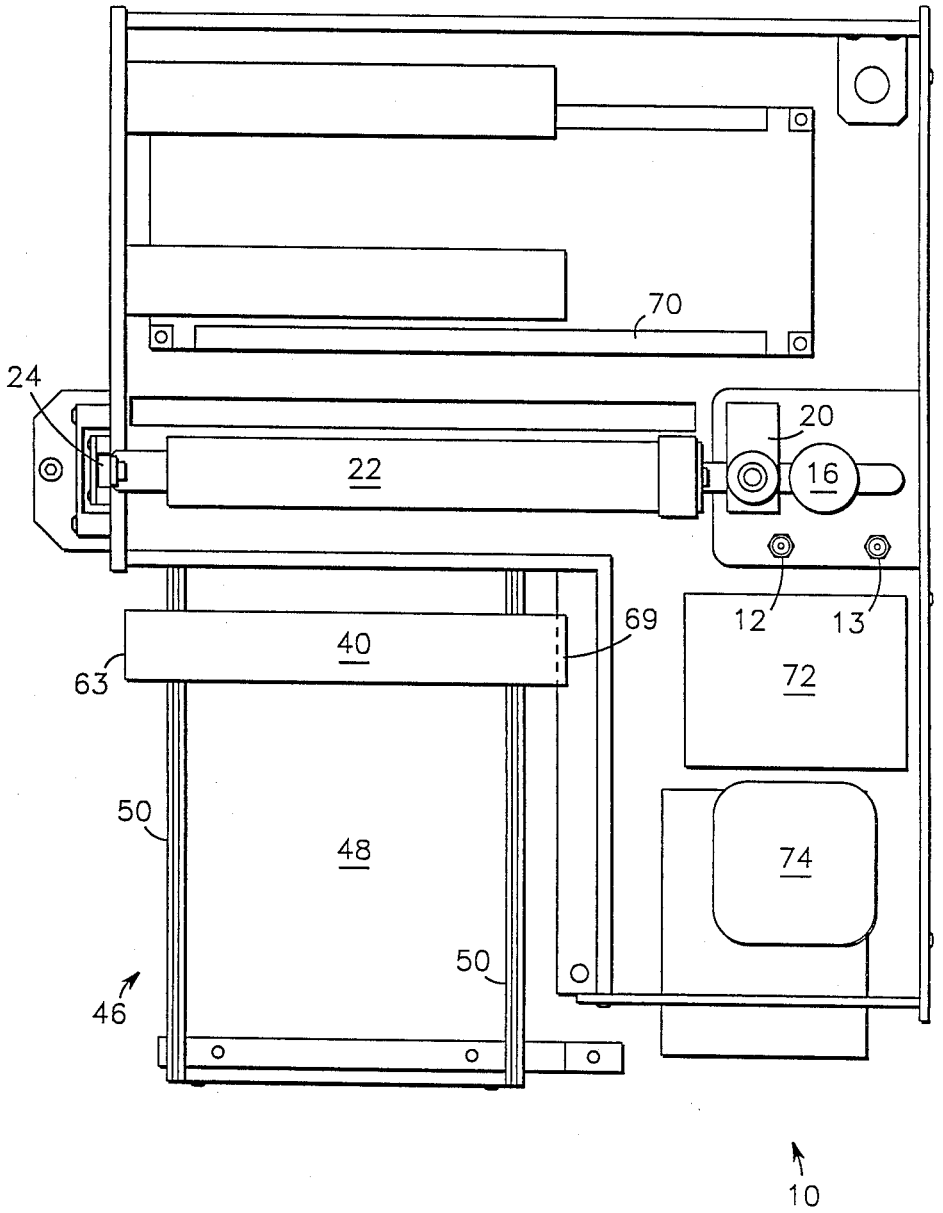
FIG. 3 is a schematic top view of the automated curing oven system for semiconductor devices.

FIGS. 1–3 are schematic front, side and top views, respectively, of an automated curing oven system 10 for semiconductor devices. Curing oven system 10 includes a gas injection port 12 beside which is an air injection port 13. Gas injection port 12 is to be coupled to an outside gas source while air injection port 13 is to be coupled to an outside air source when curing oven system 10 is in operation. One skilled in the art will understand that means for allowing and prohibiting gas and air flow through ports 12 and 13 respectively will be included. It should further be understood that the means for allowing and prohibiting gas and air flow may or may not be disposed on ports 12 and 13 themselves, but on the outside gas and air sources. The gas which flows through gas injection port 12 will serve to heat and cool curing oven system 10 while the air that flows through air injection port 13 will serve to operate various pneumatic devices throughout curing oven system 10 which will be explained presently.

A directional flow tube 14 is coupled to gas injection port 12. Gas will flow through gas injection port 12 into directional flow tube 14 where it will be directed to either heat or cool the semiconductor devices in curing oven system 10. For heating, gas will flow through an open heater flow valve 16 into a flow tube 18. Coupled to flow tube 18 is a pressure sensor 20 which detects whether or not gas is actually flowing through flow tube 18. It is important that gas is flowing into heater 22 while it is turned on because heater 22 may be ruined if it is subjected to no gas flow while it is turned on. Flow tube 18 is further coupled to heater 22 which heats gas flowing through it. Heater 22 feeds the gas flow into a manifold 24.

For cooling, closed heater flow valve 16 will direct the gas flow into flow tube 26 which is coupled to a cooler flow valve 28. It should be understood that cooler flow valve 28 will be closed during the heating process however it will be open during the cooling process. During the cooling process, gas will flow through open cooler flow valve 28 through flow tube 30. A pressure sensor 32 is coupled to flow tube 30 and detects whether or not gas is actually flowing. Flow tube 30 then feeds into manifold 24. It should be understood that the cooling system may actually include means for cooling the gas flow if needed although this embodiment does not include such means.

Manifold 24 contains a thermocouple 34 disposed therein. Thermocouple 34 measures the temperature of the gas in manifold 24 thereby allowing temperature readings to be obtained. Once gas flows into manifold 24 from either the heating system or the cooling system, it is forced toward manifold face plate 36. Manifold face plate 36 separates manifold 24 from the oven chamber area 38. Manifold face plate 36 includes a plurality of apertures through which gas flows into oven chamber area 38. The plurality of apertures may be arranged in various configurations to allow for optimum gas flow depending upon the particular oven chamber employed. This will be explained hereinafter. It should further be understood that manifold face plate 36 is removable and interchangeable.

Referring specifically to FIG. 4 and FIG. 5, an end view and a cross-sectional view of a device holding magazine 40 are shown, respectively. Device holding magazine 40 includes a first end 63 and a second end 69. Device holding magazine 40 is hollow and arranged to hold many semiconductor devices at once. A common device holding magazine configuration includes a plurality of inner shelves 43, each shelf 43 being able to support a series of semiconductor device leadframes. Because device holding magazine 40 serves as the actual oven chamber, it should be understood that the configuration of the apertures of manifold face plate 36 will be such that they correspond to the design of device holding magazine 40 to insure optimum gas flow through it. The gas flow must be even throughout device holding magazine 40 to insure consistent curing of all semiconductor devices contained therein. This even gas flow is obtained by forcing a large volume of gas into manifold 24 compared to the volume of gas which may flow through the apertures of manifold face plate 36. A common ratio is 4:1.

Device holding magazine 40 may be removed and is interchangeable with other device holding magazines 40 in oven chamber area 38. It should be understood that device holding magazine 40 is the same magazine that is used in various other semiconductor device assembly steps thereby minimizing the amount of manual device handling necessary. There is no need to remove the semiconductor devices from device holding magazine 40 throughout many processing steps such as other curing steps, die attachment and wire bonding.

Now referring back to FIGS. 1–5. Following the gas flowing through device holding magazine 40 in oven chamber area 38, it flows into exhaust maniflow 41. From exhaust maniflow 41, the gas is forced into magazine evacuation tubes 42. Gas flows through magazine evacuation tubes 42 into exhaust tube 44 which is coupled to a plant exhaust in this embodiment It should be understood, however that exhaust tube 42 may be coupled to other types of exhaust means. It should further be understood that all or some of the gas which flows through device holding magazine 40 may be recycled A baffle may be added to redirect the gas flow from device holding magazine 40 back into curing oven system 10. Whether or not gas is recycled will depend upon the amount of impurities introduced to the gas flow from its flow through device holding magazine 40 and other factors such as cost.

Various device holding magazines 40 are transported to and from oven chamber area 38 by a transporter means 46. In this embodiment, transporter means 46 includes a stationary surface 48 on which device holding magazines 40 are positioned. Stationary surface 48 is bordered by mechanical tracks 50 on each side. Mechanical tracks 50 include pivots 52 attached thereto. Pivots 52 are one way pivots which will grip and transport device holding magazines 40 when mechanical tracks 50 are moving towards oven chamber area 38. However, pivots 52 will not grip and transport device holding magazines 40 when mechanical tracks 50 move in a direction away from oven chamber area 38.

Mechanical tracks 50 are pneumatically operated by a slide 54. Slide 54 includes a valve 56 which receives air from air injection port 13 to operate slide 54. Slide 54 moves back and forth thereby allowing mechanical tracks 50 to move back and forth enabling one way pivots 52 to grip and release device holding magazines 40. Slide 54 is also coupled to an air cylinder 58 which operates pivots 60. Pivots 60 are much more intricate than pivots 52 and serve to precisely move device holding magazines 40 into oven chamber area 38. It should be understood, however, that pivots 60 and pivots 52 are all operated by slide 54.

Once a device holding magazine 40 is moved into oven chamber area 38, magazine 40 must be sealed so that a consistent gas flow may be obtained and also so that gas flow does not escape the device holding magazine 40 which is disposed in oven chamber area 38. To do this, a pneumatic cylinder 62 is employed. Pneumatic cylinder 62 is also operated by air brought in through air injection port 13. Pneumatic cylinder 62 forces first end 63 of device holding magazine 40 against a first silicon ring 64 which is disposed between first end 63 of device holding magazine 40 and manifold face plate 36. Pneumatic cylinder 62 also forces device holding magazine 40 against a spring 66 which is disposed beneath manifold 24. Spring 66 is compressed thereby allowing for a secure fit between first end 63 of device holding magazine 40 and first silicon ring 64. A second silicon ring 68 is disposed between second end 69 of device holding magazine 40 and exhaust maniflow 41. Second silicon ring 68 allows for an air tight seal between second end 69 of device holding magazine 40 and exhaust maniflow 41.

Automated curing oven system 10 is controlled by a central processing unit (CPU) 70. Virtually all of the vital operational parameters are controlled by CPU 70. Various operations which are controlled by the CPU include the power which is supplied to heater 22. This is done through a power module 72. CPU 70 also control fans 74 which serve to cool automated curing oven system 10. CPU 70 further controls the temperature of heater 22 through the temperature adjustment pot 76 and the temperature control 78. CPU 70 may be programmed to control other parameters such as heating time, cooling time and the pneumatic operations of curing oven system 10. Further, CPU 70 allows for readings of the vital parameters to be obtained.

Thus it is apparent that there has been provided, in accordance with the invention, a new and improved automated curing oven system for semiconductor devices which meets the objects and advantages set forth above. While specific embodiments of this invention have been shown and described, further modifications and improvements will occur to those skilled in the art. It is desired that it be understood, therefore, that this invention is not limited to the particular form shown and it is intended in the appended claims to cover all modifications which do not depart from the spirit and scope of this invention.

What is claimed is:

1. An automated curing oven system for semiconductor devices comprising:

means for injecting gas flow into said system;

gas heating means selectively coupled to said means for injecting gas flow;

cooling means selectively coupled to said means for injecting gas glow;

gas distributing means selectively coupled to both said gas heating means and said cooling means;

flow-through device holding means having a first end and a second end, said first end to be coupled to said gas distributing means, said flow-through device holding means further being removable;

exhaust maniflow means to be coupled to said second end of said flow-through device holding means;

clamping and sealing means for making air-tight seals between said gas distributing means and said first end of said flow-through device holding means and also between said exhaust maniflow means and said second end of said flow-through device holding means; and transporter means on which said flow-through device holding means is movably disposed and transported.

2. The oven system of claim 1 wherein said oven system is controlled by a central processing unit which is incorporated in said oven system.

3. The oven system of claim 2 wherein said means for injecting gas flow includes valve means for selectively directing the gas flow to the gas heating means or the cooling means.

4. The oven system of claim 2 wherein the gas distributing means includes a manifold having a face plate which comprises of plurality of apertures, said face plate further being removable and interchangeable.

5. The oven system of claim 4 wherein the plurality of apertures are arranged in a predetermined manner to correspond with the flow-through device holding means so that the gas flow will enter said device holding means at its first end and flow to its second end.

6. The oven system of claim 5 wherein the flow-through device holding means is employed as an oven chamber.

7. The oven system of claim 2 wherein the exhaust maniflow means includes gas recirculation means.

8. The oven system of claim 2 wherein the clamping and sealing means includes a first gasket disposed between the first end of the flow-through device holding means and the gas distributing means and a second gasket disposed between the second end of said flow-through device holding means and the exhaust maniflow means, said clamping and sealing means further including means for contacting said first and second gaskets to said respective ends of said device holding means.

9. A curing oven system for semiconductor devices comprising:

a heater;

cooling means;

valve means coupled to both said heater and said cooling means, said valve means to selectively direct gas flow into either said heater or said cooling means, said valve means further coupled to a gas flow source;

a manifold selectively coupled to said heater and said cooling means;

a magazine for holding semiconductor devices, said magazine having a first end and a second end, said first end to be coupled to said manifold, said magazine further being removable;

an exhaust maniflow to be coupled to said second end of said magazine;

clamping and sealing means for making air-tight seals between said manifold and said first end of said magazine and also between said exhaust maniflow and said second end of said magazine; and a magazine transporter on which said magazine is movably disposed and transported throughout said curing oven system.

10. The oven system of claim 9 wherein said oven system is controlled by a central processing unit which is incorporated in said oven system.

11. The oven system of claim 10 wherein the manifold includes a removable and interchangeable face plate which comprises a plurality of apertures.

12. The oven system of claim 11 wherein the plurality of apertures are arranged in a predetermined manner to correspond with the magazine so that the gas flow will enter said magazine at its first end and flow to its second end.

13. The oven system of claim 12 wherein the magazine is employed as an oven chamber.

14. The oven system of claim 10 wherein the exhaust maniflow includes gas recirculation means.

15. The oven system of claim 10 wherein the clamping and sealing means includes a first gasket disposed between the first end of the magazine and the manifold and a second gasket disposed between the second end of said magazine and the exhaust maniflow, said clamping and sealing means further including means for contacting said first and second gaskets to said respective end of said magazine.

16. An automated curing oven system for semiconductor devices comprising:

a heater;

cooling means;

at least one valve coupled to a gas flow source, said at least one valve further coupled to said heater and said cooling means to selectively direct gas flow into either said heater or said cooling means;

a manifold having a removable and interchangeable face plate and being selectively coupled to said heater and said cooling means;

a semiconductor device magazine having a first open end and a second open end, said first end to be coupled to said manifold when said magazine is disposed in an oven chamber area, said magazine further being removable;

an exhaust maniflow to be coupled to said second end of said magazine;

a first gasket disposed between said first end of said magazine and said manifold;

a second gasket disposed between said second end of said magazine and said exhaust maniflow;

means for making contact between said first and second gaskets and said first and second end of said magazine respectively;

a magazine transporter on which said magazine is movably disposed and transported; and a central processing unit to control said oven system, said central processing unit being incorporated therein.

17. The oven system of claim 16 wherein the manifold face plate comprises a plurality of apertures arranged in a predetermined manner to correspond with the magazine so that the gas flow enters said magazine at its first end and flows to its second end.

18. The oven system of claim 17 wherein the magazine is employed as an oven chamber.

19. The oven system of claim 18 wherein the exhaust maniflow includes a baffle which recirculates gas to the at least one valve.

* * * * *